US011359370B2

(12) United States Patent
Spina et al.

(10) Patent No.: US 11,359,370 B2
(45) Date of Patent: Jun. 14, 2022

(54) BLOCK FOR DRY CONSTRUCTION

(71) Applicants: Contern S.A., Contern (LU); Université du Luxembourg, Esch-sur-Alzette (LU)

(72) Inventors: Carlo Spina, Eisenbach (LU); Danièle Waldmann-Diederich, Mensdorf (LU); Gelen Gael Chewe Ngapeya, Pétange (LU); Shahriar Agaajani, Luxembourg (LU)

(73) Assignee: ASARS CONSTRUCTIONS, Luxembourg (LU)

( * ) Notice: Subject to any disclaimer, the term of this patent is extended or adjusted under 35 U.S.C. 154(b) by 319 days.

(21) Appl. No.: 16/341,609

(22) PCT Filed: Oct. 13, 2017

(86) PCT No.: PCT/EP2017/076241
§ 371 (c)(1),
(2) Date: Apr. 12, 2019

(87) PCT Pub. No.: WO2018/069524
PCT Pub. Date: Apr. 19, 2018

(65) Prior Publication Data

US 2021/0131097 A1 May 6, 2021

(30) Foreign Application Priority Data

Oct. 14, 2016 (LU) ..... 93263

(51) Int. Cl.
*E04B 2/18* (2006.01)
*E04B 2/02* (2006.01)

(52) U.S. Cl.
CPC ..... *E04B 2/18* (2013.01); *E04B 2002/0206* (2013.01); *E04B 2002/0208* (2013.01); *E04B 2002/0228* (2013.01)

(58) Field of Classification Search
CPC ..... E04B 2/18; E04B 2002/0206; E04B 2002/0208; E04B 2002/0228; E04B 2002/023; E04B 2/44
See application file for complete search history.

(56) References Cited

U.S. PATENT DOCUMENTS 1,171,191 A * 2/1916 Gronert ..... E04B 2/18 52/591.1
2,179,407 A * 11/1939 Flores ..... E04B 2/14 52/591.2

(Continued)

FOREIGN PATENT DOCUMENTS

FR 1202814 A 1/1960
FR 1312989 A 12/1962

(Continued)

OTHER PUBLICATIONS

International Search Report dated Jan. 2, 2018 for Parent PCT Appl. No. PCT/EP2017/076241.

*Primary Examiner* — Rodney Mintz
(74) *Attorney, Agent, or Firm* — James E. Walton

(57) ABSTRACT

The invention relates to a construction block (2) made of inert material, such as concrete, comprising two opposite main faces (4, 6), an upper face (8), a lower face (10), and two opposite lateral faces (12, 14), the upper and lower faces (8, 10) and the lateral faces (12, 14) having, respectively, complementary reliefs that are able to interlock when several of the blocks are juxtaposed. The relief of the upper face (8) comprises two tenons (16) extending in parallel and at a distance from the two main faces (4, 6), respectively, and the relief of the lower face (10) comprises two corresponding slots (16') extending in parallel and at a distance from the two main faces (4, 6), respectively.

22 Claims, 5 Drawing Sheets

(56) References Cited

U.S. PATENT DOCUMENTS 2,634,602 A * 4/1953 Zagray ..... E04B 5/44 52/436
2,687,034 A * 8/1954 Blanc ..... E04B 2/18 52/408
2,749,739 A * 6/1956 Zagray ..... B28B 7/0079 52/286
2,811,035 A * 10/1957 Zagray ..... E04B 1/6812 52/436
2,882,715 A * 4/1959 Zagray ..... E04B 2/54 52/436
3,534,518 A * 10/1970 Zagray ..... F27B 9/26 52/258
3,818,656 A * 6/1974 Vigliotti ..... E04C 1/397 52/100
4,075,808 A * 2/1978 Pearlman ..... E04B 2/54 52/439
4,095,384 A * 6/1978 Zarriello ..... E04B 2/48 52/408
4,295,313 A * 10/1981 Rassias ..... E04B 2/52 52/436
4,319,440 A * 3/1982 Rassias ..... E04B 2/52 52/438
4,557,093 A * 12/1985 Beliveau ..... E04B 2/18 52/405.4
4,557,094 A * 12/1985 Beliveau ..... E04B 2/18 52/405.4
4,698,949 A * 10/1987 Dietrich ..... E04B 2/44 52/415
5,904,763 A * 5/1999 Blocken ..... C04B 18/20 106/696
5,992,102 A * 11/1999 Ozawa ..... E04B 2/44 52/100
6,145,267 A * 11/2000 Pardo ..... B28B 7/00 52/606
7,096,636 B1 * 8/2006 Neill ..... E04B 2/46 52/438
7,882,674 B2 * 2/2011 Craven ..... E04B 2/18 52/606
8,091,308 B2 * 1/2012 Westmoreland ..... E04C 1/41 52/309.12
8,596,014 B2 * 12/2013 Genest ..... E04B 2/52 52/600
8,640,407 B2 * 2/2014 Alsayed ..... E04C 1/397 52/220.1
8,863,476 B2 * 10/2014 Summers ..... E04B 2/02 52/747.12
9,309,667 B2 * 4/2016 Thompson ..... E04C 1/397
9,863,145 B2 * 1/2018 Genest ..... E04C 1/41
10,060,124 B2 * 8/2018 Rodenburgh ..... E04F 13/0835
10,106,980 B2 * 10/2018 Martinez ..... E04B 2/08
2007/0266656 A1 * 11/2007 Blocken ..... E04C 1/40 52/286
2008/0060300 A1 * 3/2008 Westmoreland ..... E04B 2/8629 52/405.4
2008/0134616 A1 * 6/2008 Craven ..... E04B 2/24 52/606
2011/0146186 A1 * 6/2011 Summers ..... E04B 2/08 52/568
2012/0260603 A1 * 10/2012 Thompson ..... E04B 2/08 52/762
2013/0276400 A1 * 10/2013 Genest ..... E04B 2/52 52/600
2013/0333313 A1 * 12/2013 Alsayed ..... E04B 2/54 52/220.1
2017/0016228 A1 * 1/2017 Hashemian ..... E04B 2/24
2017/0145690 A1 * 5/2017 Genest ..... E04C 1/397
2018/0044914 A1 * 2/2018 Martinez ..... E04C 1/39
2018/0209143 A1 * 7/2018 Rodenburgh ..... E04B 2/08

FOREIGN PATENT DOCUMENTS

FR 1599146 A 7/1970
FR 2575778 A1 7/1986
FR 2892436 A1 4/2007
GB 166623 A 7/1921
WO 1997025499 A1 7/1997
WO 2012160150 A1 11/2012

* cited by examiner

BLOCK FOR DRY CONSTRUCTION

TECHNICAL FIELD

The invention lies in the field of the construction of buildings, more particular in the field of construction blocks, notably made of inert material such as concrete.

PRIOR ART

The published patent document WO 97/25499 A1 discloses a hollow construction block provided, on each of its upper, lower, and lateral faces with reliefs that are able to interlock with one another when several blocks are assembled alongside one another and/or on top of one another. Such blocks can be assembled "dry", that is to say without the use of mortar. The cavities in the blocks are intended to be filled with cement or mortar in order to stabilize the wall thus constructed. Therefore, such a block is not suitable for exclusively dry construction, that is to say without the addition of cement into the voids. The main reason appears to be that the vertical portions referred to as "tongues", situated between the plates forming the main faces, fail to ensure sufficiently precise interlocking. Specifically, in the case of a foreign body and/or irregularity at the upper face of one of these vertical portions, the upper block will inevitably exhibit a deviation with respect to the vertical. Such a deviation is likely to destabilize the wall, risking it collapsing, mainly because of the lack of resistance of the blocks to coming apart.

The published patent document WO 2012/160150 A1 likewise discloses a concrete construction block intended for the "dry" construction of walls. To this end, the block comprises, similarly to the previous document, vertical portions forming transverse bosses on the upper face and voids in the lower face. These vertical portions are situated between two plates forming the main faces. These plates likewise comprise, on the edges at the opposite lateral faces of the block, profiles of the tenon/mortice type. However, these profiles are very small in size and can cause problems with regard to manufacturing tolerances, and as regards the assembly thereof when irregularities or other defects are present in these profiles.

SUMMARY OF THE INVENTION

Technical Problem

The objective of the invention is to remedy at least one of the drawbacks of the abovementioned prior art. More particularly, the objective of the invention is to propose a construction block that allows dry assembly while ensuring sufficient stability, notably for walls of a certain height.

Technical Solution

The subject of the invention is a construction block made of inert material, such as concrete, comprising two opposite main faces, an upper face, a lower face, and two opposite lateral faces, the upper and lower faces and the lateral faces having, respectively, complementary reliefs that are able to interlock when several of the blocks are juxtaposed; said block being noteworthy in that the relief of the upper face comprises two tenons extending in parallel and at a distance from the two main faces, respectively, and the relief of the lower face comprises two corresponding slots extending in parallel and at a distance from the two main faces, respectively.

According to one advantageous embodiment of the invention, said block comprises voids and a continuity of material between each of the tenons of the upper face and the corresponding slot of the lower face. The continuity of material advantageously has a thickness at least equal to the thickness of the corresponding tenon, specifically from the tenon to the corresponding slot.

According to one advantageous embodiment of the invention, the voids comprise voids extending vertically between the tenons of the upper face and the corresponding slots of the lower face.

According to one advantageous embodiment of the invention, the voids comprise voids extending vertically between, for the one part, each of the main faces and, for the other part, the adjacent tenon of the upper face and the adjacent corresponding slot of the lower face.

According to one advantageous embodiment of the invention, each of the tenons of the upper face has a thickness of between 10% and 17% of the width of the block.

According to one advantageous embodiment of the invention, each of the tenons of the upper face is at a distance from the adjacent main face of between 20 and 25% of the width of the block.

According to one advantageous embodiment of the invention, each of the upper face and lower face has a generally straight transverse profile on either side of the two tenons of said upper face and the two slots of said lower face, respectively.

Advantageously, the transverse profile of the upper face has a horizontal central part that is vertically set back with respect to the horizontal lateral portions on either side of the tenons. This setback may be greater than or equal to 1 mm.

According to one advantageous embodiment of the invention, each of the tenons of the upper face has a height greater than the thickness of said tenon, and each of the slots of the lower face has a depth greater than the width of said slot.

According to one advantageous embodiment of the invention, the relief of a first of the two opposite lateral faces comprises at least two vertically extending tenons and the relief of the second of the two opposite lateral faces comprises at least two corresponding slots.

According to one advantageous embodiment of the invention, the at least two tenons of the first lateral face comprise a central tenon and two lateral tenons on either side of the central tenon, and the at least two slots of the second lateral face comprise a corresponding central slot and two corresponding lateral slots on either side of the central slot.

According to one advantageous embodiment of the invention, the central tenon of the first lateral face and the corresponding central slot of the second lateral face have a trapezoidal section.

According to one advantageous embodiment of the invention, the central tenon of the first lateral face and the corresponding central slot of the second lateral face are situated transversely between the two tenons of the upper face and between the two slots of the lower face.

According to one advantageous embodiment of the invention, the central tenon of the first lateral face and the corresponding central slot of the second lateral face have a maximum width of between 25% and 30% of the width of the block.

According to one advantageous embodiment of the invention, each of the two lateral tenons of the first lateral face is aligned with the adjacent main face, and each of the two lateral slots of the second lateral face is aligned with the adjacent main face.

According to one advantageous embodiment of the invention, each of the at least two lateral tenons of the first lateral face has a height of between 8% and 15% of the width of the block.

A further subject of the invention is a construction block made of inert material, such as concrete, comprising two opposite main faces, an upper face, a lower face, and two opposite lateral faces, the upper and lower faces and the lateral faces having, respectively, complementary reliefs that are able to interlock when several of the blocks are juxtaposed; said block being noteworthy in that said block comprises one or more levelling layers, on the upper face and/or on the lower face, that have a thickness greater than 5 mm and/or less than 40 mm and are made of a mortar having a Young's modulus less than 4000 MPa and/or a compressive strength less than 6 MPa.

The levelling layer(s) come into contact with the vertically adjacent block so as to ensure load transfer.

According to one advantageous embodiment of the invention, the mortar has a Young's modulus greater than 1000 MPa and/or a compressive strength greater than 1 MPa.

According to one advantageous embodiment of the invention, the mortar comprises a binder, preferably based on cement, and granules, the average diameter of which is less than 50% of the thickness of the corresponding levelling layer.

According to one advantageous embodiment of the invention, the mortar comprises a binder, preferably based on cement, and granules, the average diameter of which is less than 1.5 mm, preferably less than 1 mm.

According to one advantageous embodiment of the invention, the material forming a central part of the block, preferably corresponding to the rest of the block, is a concrete having a Young's modulus greater than 20 000 MPa and/or a compressive strength greater than 20 MPa.

According to one advantageous embodiment of the invention, the levelling layers on the upper face are situated on the tenons and/or laterally, towards the outside, with respect to said tenons.

According to one advantageous embodiment of the invention, the levelling layers on the lower face are situated at the bottom of the slots and/or laterally, towards the outside, with respect to said slots.

According to one advantageous embodiment of the invention, the levelling layer(s) extend(s) along the entire length of the block.

Advantages of the Invention

The measures of the invention are advantageous in that they ensure a dry assembly without it being necessary to fill the inside of the blocks with cement, concrete and/or insulation, while having satisfactory stability. The block of the invention thus makes it possible to construct walls of the temporary partition type, that is to say ones that can be dismantled very easily without damage and without any particular effort. The main faces can have a particular surface finish. Following the construction of a wall with the blocks of the invention, said blocks can then be painted on the faces in question.

The presence of at least two tenons on the upper face and, similarly, of two corresponding slots in the lower face makes it possible to ensure a good level of stability, notably for the construction of walls notably with a height of 6 m or more. The tenons and corresponding slots on/in the opposite lateral faces also allow exact adjustment of the blocks. The block of the invention has been the subject of statistical studies as part of a doctoral thesis.

The use of a specific material that is less resistant and/or brittle at the upper face and/or the lower face causes a levelling effect that makes it possible to distribute loads better, notably in the event of misalignment of the blocks once assembled to form a wall or a partition. This levelling effect is particularly advantageous in the context of a dry construction, that is to say one in which there is no layer of assembly mortar in the form of a paste.

DESCRIPTION OF AN EMBODIMENT

Figure 1:
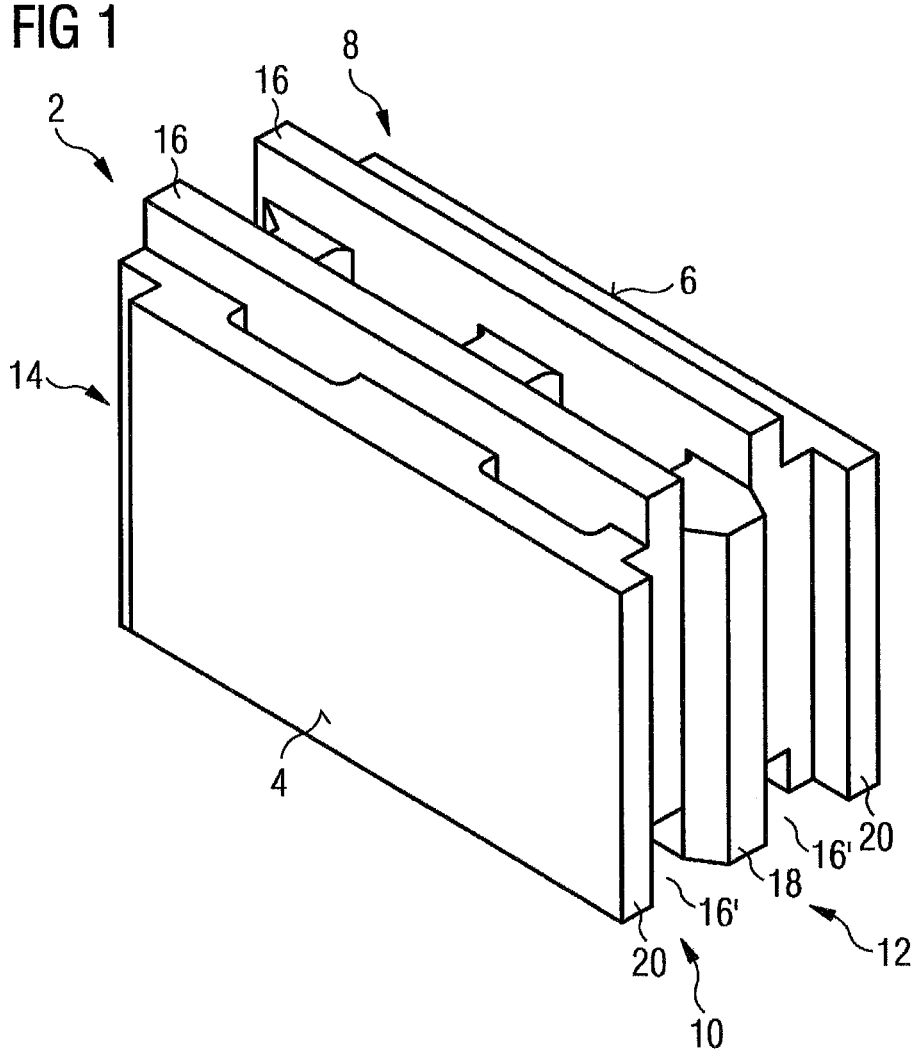
FIG. 1 is a perspective view of a construction block according to a first embodiment of the invention.
Figure 2:
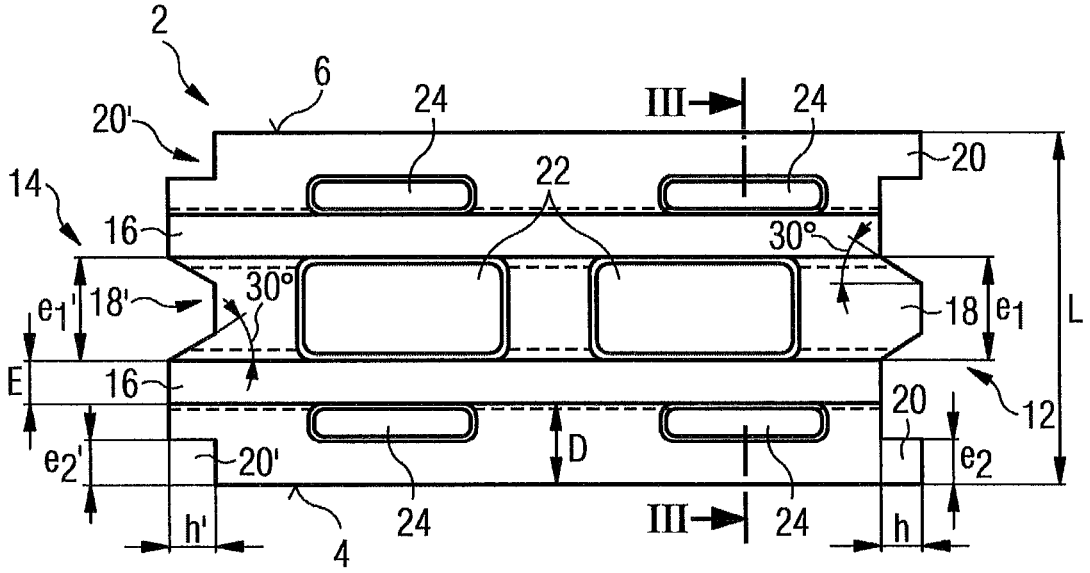
FIG. 2 is an elevation view of the block in FIG. 1.
Figure 3:
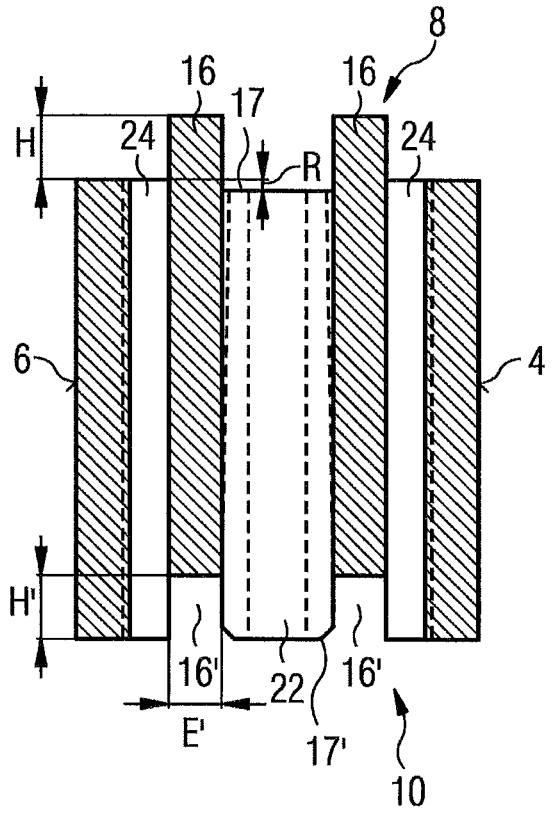
FIG. 3 is a view on the section line of the block in FIG. 2.
Figure 4:
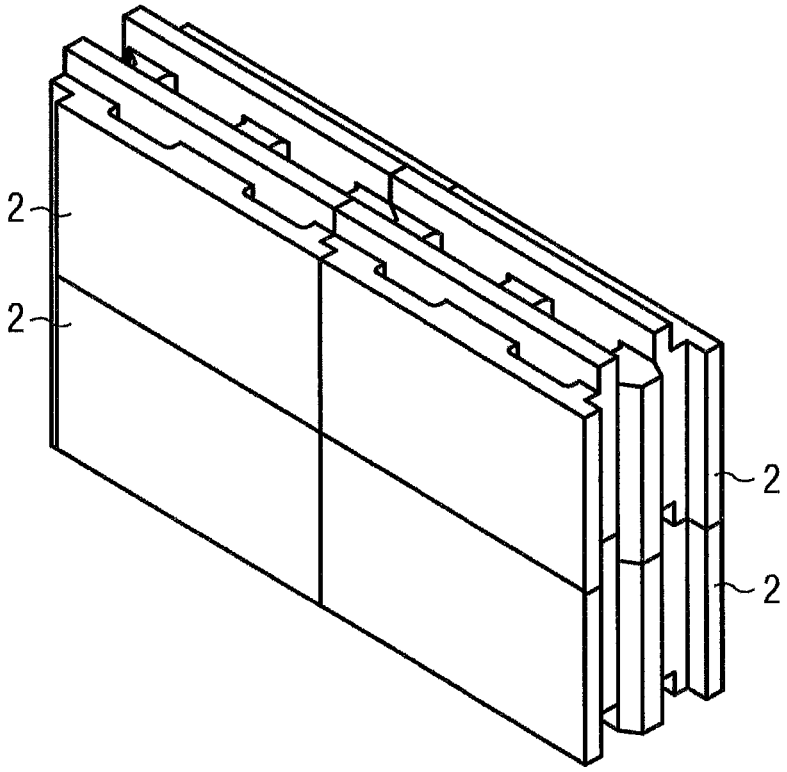
FIG. 4 is a perspective view of a portion of wall constructed with blocks as per the block in FIGS. 1 to 3.

FIGS. 1 to 3 illustrate a construction block according to a first embodiment of the invention. This block 2 is made of inert construction material, such as concrete. It has a parallelepipedal overall shape. In FIG. 1, it is illustrated in its functional orientation. The notions of orientation such as "upper", "lower, "lateral", "vertical", "longitudinal" and "transverse" mentioned in this document refer to the block in its functional orientation as illustrated in FIG. 1.

The block 2 comprises main faces 4 and 6, which extend longitudinally and parallel to one another. These faces are intended to remain visible after several blocks have been assembled. The block 2 also comprises an upper face 8, a lower face 10 and two opposite lateral faces 12 and 14. Each of the upper face 8, lower face 10 and lateral faces 12 and 14 comprises a relief that is able to cooperate by interlocking with a corresponding face of another, identical block disposed adjacent thereto.

More specifically, the upper face 8 comprises two tenons 16 that extend longitudinally, advantageously continuously between the two lateral faces 12 and 14. The lower face 10 comprises two corresponding slots 16', which then likewise extend longitudinally and advantageously continuously between the two lateral faces 12 and 14. These slots 16' are dimensioned so as to receive the tenons 16 of another, identical block supporting the block 2. It is apparent, notably in FIGS. 2 and 3, that the block 2 has a continuity of material, in a vertical direction, between each of the tenons 16 and the corresponding slot 16'.

With reference to FIG. 2, the tenons 16 of the upper face 8 have a thickness E which is advantageously between 10% and 17% of the width L of the block. The same goes for the width E' of the corresponding slots 16' (FIG. 3). For a width L of 175 mm (6.89"), each of the tenons 16 may have a thickness E of around 22 mm (0.87"), and each of the slots 16 ' may have a width E' of 25 mm (0.98"). A clearance is provided between each of the slots and the corresponding tenon. This clearance may be between 1 (0.04") and 5 mm (0.2"), preferably between 2 (0.08") and 4 mm (0.16"), more preferably between 2.5 (0.1") and 3.5 mm (0.138").

With reference to FIG. 3, the tenons 16 have a height H which is advantageously greater than its thickness E (FIG. 2). For a thickness E of 22 mm (0.87"), the height H may be around 30 mm (1.18"). The depth H' of the slots 16' is advantageously equal to the height H of the tenons 16. This measure is advantageous in that it ensures that vertical forces are absorbed by the tenons 16 and are transmitted directly to the corresponding slots 16'.

It is also apparent that the two tenons 16 are disposed symmetrically on either side of a longitudinal axis of the block 2 and that each of these tenons is at a distance from the adjacent main face 4 and 6. This distance D may be between 20% and 25% of the width L of the block. For a width L of 175 mm (6.89"), the distance D may be around 40 mm (1.57").

Voids 22 may be provided transversely between the tenons 16, these voids extending vertically through the block, from the upper face 8 to the lower face 10. Similarly, voids 24 may be provided between each of the tenons 16 and the adjacent main face 4 or 6, these voids passing vertically through the block from one side to the other.

The first face 12 of the two lateral faces comprises three vertical tenons, namely a central tenon 18 and two lateral tenons 20. The central tenon 18 advantageously has a trapezoidal section. It extends transversely between the two tenons 16 and between the two corresponding slots 16'. The inclination angle of the lateral faces of the trapezoidal section may be 30°, as indicated in FIG. 2. However, this angle may assume other values, notably between 20° and 40° or between 25° and 35°. The lateral tenons 20 are particular in that they are flush with the adjacent main face 4 and 6.

The second face 14 of the two lateral faces comprises three slots, namely a central slot 18' and two lateral slots 20', corresponding to the central tenon 18 and the lateral tenons 20, respectively.

With reference more specifically to FIG. 2, the central tenon 18 has a maximum thickness $e_1$ which may correspond to the distance between the two tenons 16. The lateral tenons 20 have a thickness $e_2$ which may be between 8% and 15% of the width L of the block 2. For a width L of 175 mm (6.89"), the thickness $e_2$ may be around 20 mm (0.79"). The maximum width $e_1'$ of the central slot 18' is advantageously greater than the thickness $e_1$ of the central tenon 18, namely by a value of between 3 (0.12") and 6 mm (0.24").

The height h of the central tenon 18 and of the lateral tenons 20 is advantageously the same, between 8% and 15% of the width L of the block 2. For a width L of 175 mm (6.89"), the height h may be around 20 mm (0.79"). The depth h' of the central slot 18' and of the lateral slots 20' is advantageously greater than the height h of the central tenon 18 and of the lateral tenons 20, for example by a value of between 1 (0.04") and 3 mm (0.16").

With reference to FIG. 3, it is apparent that the transverse profiles of the upper face 8 and of the lower face 10 are generally straight apart from the bosses formed by the tenons 16 and the voids formed by the slots 16'. This is particularly favourable in order for the blocks to fit stably together. More particularly, it is apparent from FIG. 3 that the central part 17 of the transverse profile of the upper face 8 is set back R from the lateral parts. This setback may be between 1 (0.04") and 3 mm (0.16"). This measure ensures that the contact between the blocks at the upper and lower faces thereof takes place at the lateral portions of said faces and not at the centre. If this were the case, the presence of irregularities and/or a foreign body in this central portion would have the effect of destabilizing the fitting together of the blocks and, as a result, a deviation with respect to the vertical. The central part 17' of the transverse profile of the lower face 10 may be aligned with the lateral parts of said face.

The block that has just been described may have a length of 350 mm (13.78") and a height of 200 mm (7.87"). However, it will be understood that these dimensions are purely by way of example and that other dimensions are conceivable. This is also why the majority of the dimensions detailed above have been expressed as a percentage in order to be applied to other block dimensions.

The block may be produced by injecting the inert material into moulds, followed by hardening and demoulding. The block is advantageously made in one piece from the inert material. The latter may comprise a binder and one or more fillers. Among these fillers, there may be bio-based materials.

The geometry of the block according to the invention that has just been described is the result of detailed studies with the objective of reconciling static strength and ease of assembly, in particular without the use of mortar.

Figure 6:
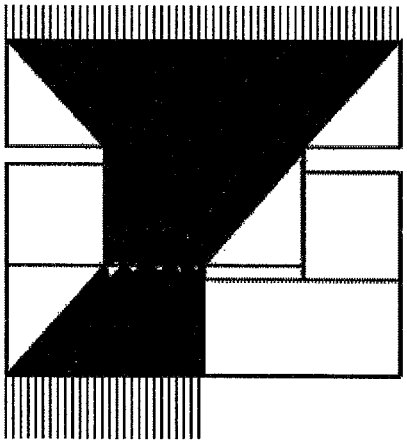
FIG. 6 schematically illustrates the passing down of load in a wall under the effect of imperfections.

FIG. 6 illustrates a construction block according to a second embodiment of the invention. The reference numerals of the first embodiment according to FIGS. 1 to 4 are used to designate the same elements, but these numerals have been increased by 100. Reference is also made to the description of these elements in relation to the first embodiment.

Figure 5:
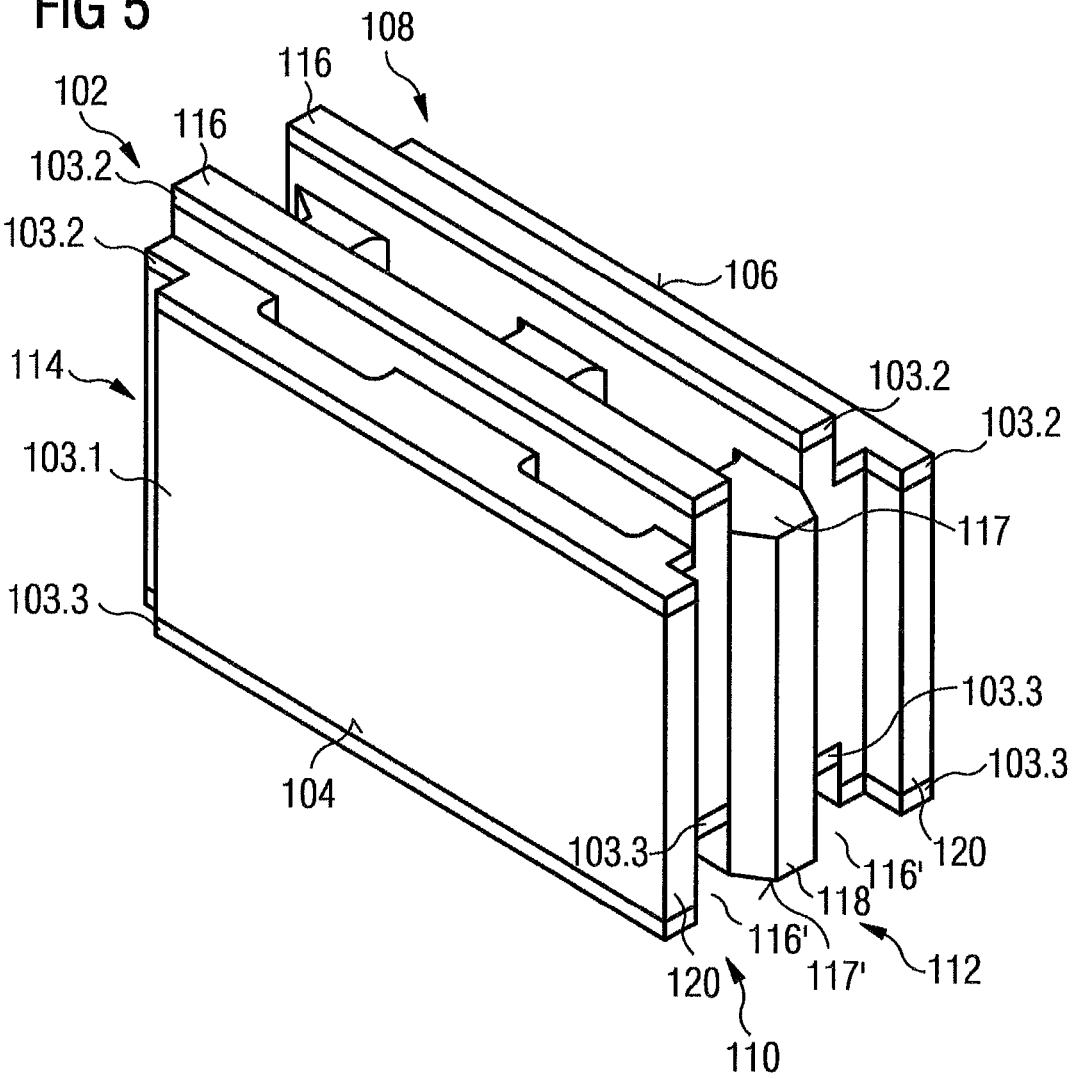
FIG. 5 is a perspective view of a construction block according to a second embodiment of the invention.

The construction block 102 illustrated in FIG. 5 is identical to the one in FIG. 1, but with the difference that the inert material of which it is made is not identical throughout the block. More specifically, the material of the construction block 102 comprises a first material forming the central and main part 103.1 of the block 102 and a second material forming the levelling layers 103.2 and 103.3 on the upper face 108 and/or lower face 110. This second material has deformation and disintegration properties that make it possible to level out any imperfections. These layers 103.2 and 103.3 extend advantageously along the entire length of the block 102, specifically, and only on the upper and/or lower contact faces. They advantageously have a thickness greater than 5 mm (0.2") and/or less than 40 mm (1.57").

The material of the levelling layers is advantageously a mortar comprising substantially granules and a cement-based binder. On account notably of the imperfections of a wall constructed from the blocks in question, the granules advantageously have an average diameter limited to half the thickness of the levelling layer and may disintegrate finely in order to increase the effective contact area in the event of a localized compressive force. More specifically, the granules, once separated from the matrix, fill the adjoining gaps in the contact interface between the rough surfaces. The compression of the levelling layer makes it possible to avoid a discontinuity of the surfaces of the superposed blocks, and thus ensures uniform load transfer between the blocks.

During any production of building blocks, the production tolerances of the machines and the effects of different contraction mean that, after drying, the blocks are almost never the same height. Moreover, the surfaces of the building blocks are in no case smooth but always have irregularities that create roughness. The dry stacking of building blocks thus gives rise to two geometric imperfections, namely:

The variation in height of the building blocks on account of the production tolerance effects; and The roughness of the contact faces on account of the inevitable presence of irregularities of variable shape and size.

Each of these imperfections has a negative effect on the strength of the blocks and of the wall in a well-defined way. Specifically, the variation in height of the blocks results in an almost unpredictable path for the passing down of load in the wall, while the roughness of the faces of the block amplifies the concentration of the loads at the dry joints. The cumulative effect of these two imperfections considerably decreases the useful section of the dry-laid masonry walls, this ultimately causing a high concentration of the loads and resulting in premature cracking of the walls.

FIG. 6 shows the cumulative influence of the geometric imperfections of the blocks on the passing down of load in a low wall, more specifically the preferred path for the passing down of load imposed by the variation in height of the building blocks. The concentration of the stresses at the dry joint between the blocks, on account of the roughness of the faces, can also be seen Ultimately, the load applied at the top of the low wall is doubled at the base of the wall, with a high risk of premature cracking at the rough joint.

Figure 7:
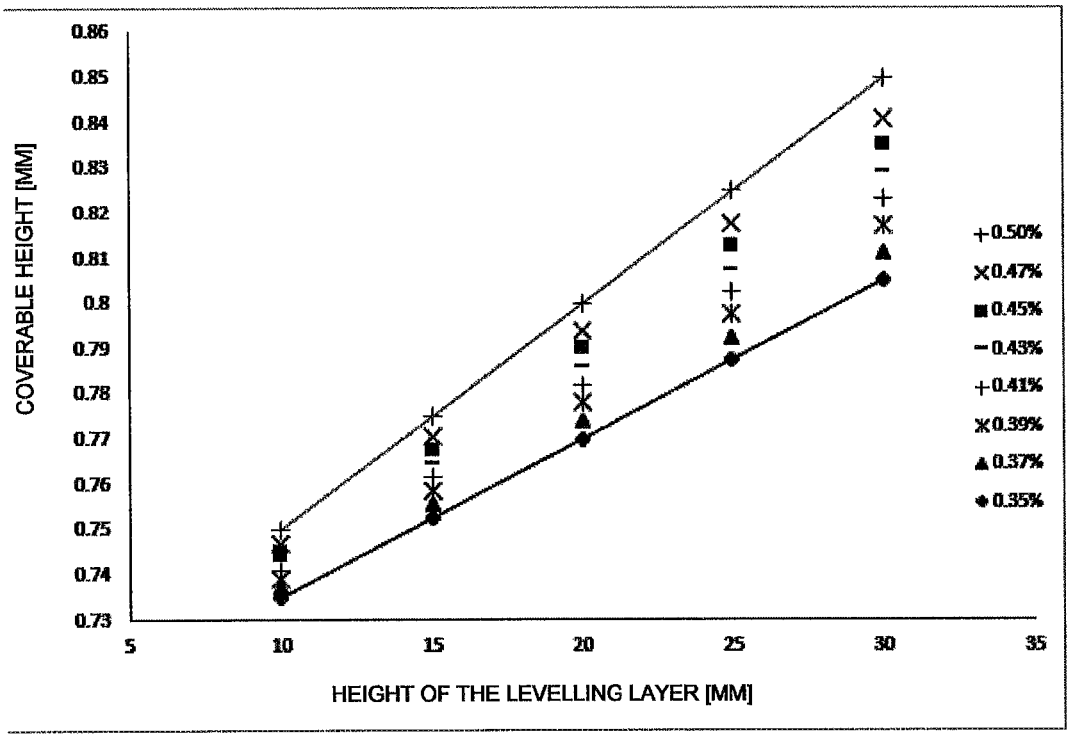
FIG. 7 illustrates the change in the compensable height depending on the thickness of the levelling layer and the ultimate deformation level of the material of said layer.

The orders of magnitude of the thickness of the levelling layer are advantageously between 5 mm (0.2") and 40 mm (1.57"), more advantageously between 10 mm (0.39") and 30 mm (1.18"), depending on the production tolerance (in terms of height) of the building blocks. FIG. 7 makes it possible to preview the height thresholds that are coverable depending on the nature of the material and the thickness of the levelling layer. In FIG. 7, the thickness of the levelling layer is given on the x-axis and the maximum coverable height is given on the y-axis. The expressed, percentages of the different curves indicate the ultimate deformation of the material used for the levelling layer. The ultimate deformation is expressed here in mm/mm and varies from 0.35% to 0.50%.

The performance of the levelling layer is substantially based on the mechanical properties of the material, which are: the compressive strength, Young's modulus, density, Poisson's ratio, granulometry and stress-deformation relationship.

Digital and experimental investigations show that the materials Mat 1, Mat 2 and Mat 3 have a high regulating potential with regard to the inevitable geometric imperfections of the dry-laid building blocks. Essentially with regard to the roughness of the laying faces of the blocks, these materials make it possible to ensure 90% uniform contact for a low load level 13% of the ultimate load of the building block).

Table 1 indicates a number of essential mechanical properties of the materials Mat 1, 2 and 3, showing the properties such as Young's modulus, the ultimate compressive strength of each material and the coefficient of friction of the above-mentioned materials.

TABLE 1

Mechanical properties of the materials

| Material | Young's Modulus [MPa] | $F_{c28}$ [MPa] | Coefficient of friction |
|---|---|---|---|
| Mat 1 | 3200 (0.464 $10^6$ lbf/in2) | 5.2 (754 lbf/in2) | 0.7 |
| Mat 2 | 2000 (0.29 $10^6$ lbf/in2) | 3.2 (464 lbf/in2) | 0.7 |
| Mat 3 | 1600 (0.232 $10^6$ lbf/in2) | 1.5 (217 lbf/in2) | 0.7 |
| Mat A | 42000 (6.091 $10^6$ lbf/in2) | 80 (11603 lbf/in2) | 0.7 |

Figure 8:
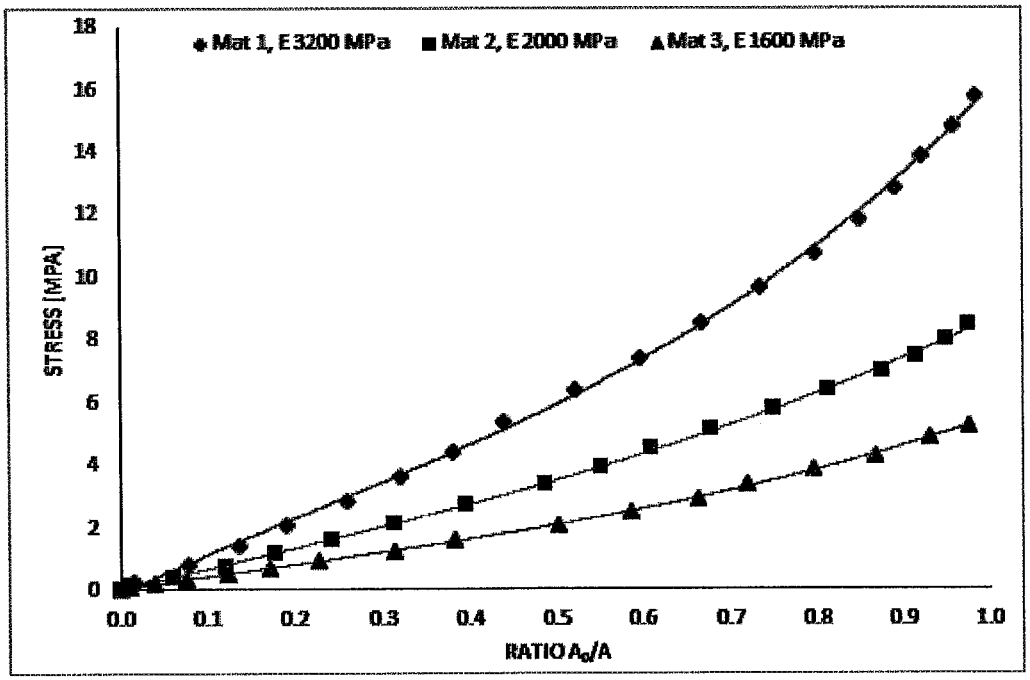
FIG. 8 illustrates the change in the useful section at the levelling layer depending on the stress and the material of said layer.

The levelling layer has a high regulating potential with regard to the imperfection of the contact surfaces. The relevance of the influence thereof is shown further by the reduction in Young's modulus of the material used. FIG. 8 shows the capacity of the levelling layer to create actual contact (Ratio $A_0/A$) depending on the level of load and for the three abovementioned materials. A represents the nominal contact section of the blocks, that is to say the theoretical section calculated from the dimensions of the contact strips. By contrast, $A_0$ represents the section actually in contact when two building blocks are superposed. This is thus the sum of the micro-sections that actually touch between the rough faces of the blocks. This being the case, the ratio $A_0/A$ varies from 0 (no actual contact) to 1 (actual contact virtually equal to the nominal section).

The variation in height of the building blocks with respect to one another reduces the useful section in the different rows of dry-laid walls. In order to analyse their effect and see the influence of the contact layer, an analytical and statistical approach has been developed. Statistical studies which have been carried out on several systems for passing down load in walls have resulted in the curves shown in FIG. 9. This figure shows the ratio $A_0/A$ of the useful section of a wall to its nominal section, depending on the capacity of the contact layer to compensate a variation in height. The coverable height and its influence on the useful section of the wall are shown in FIG. 7.

Figure 9:
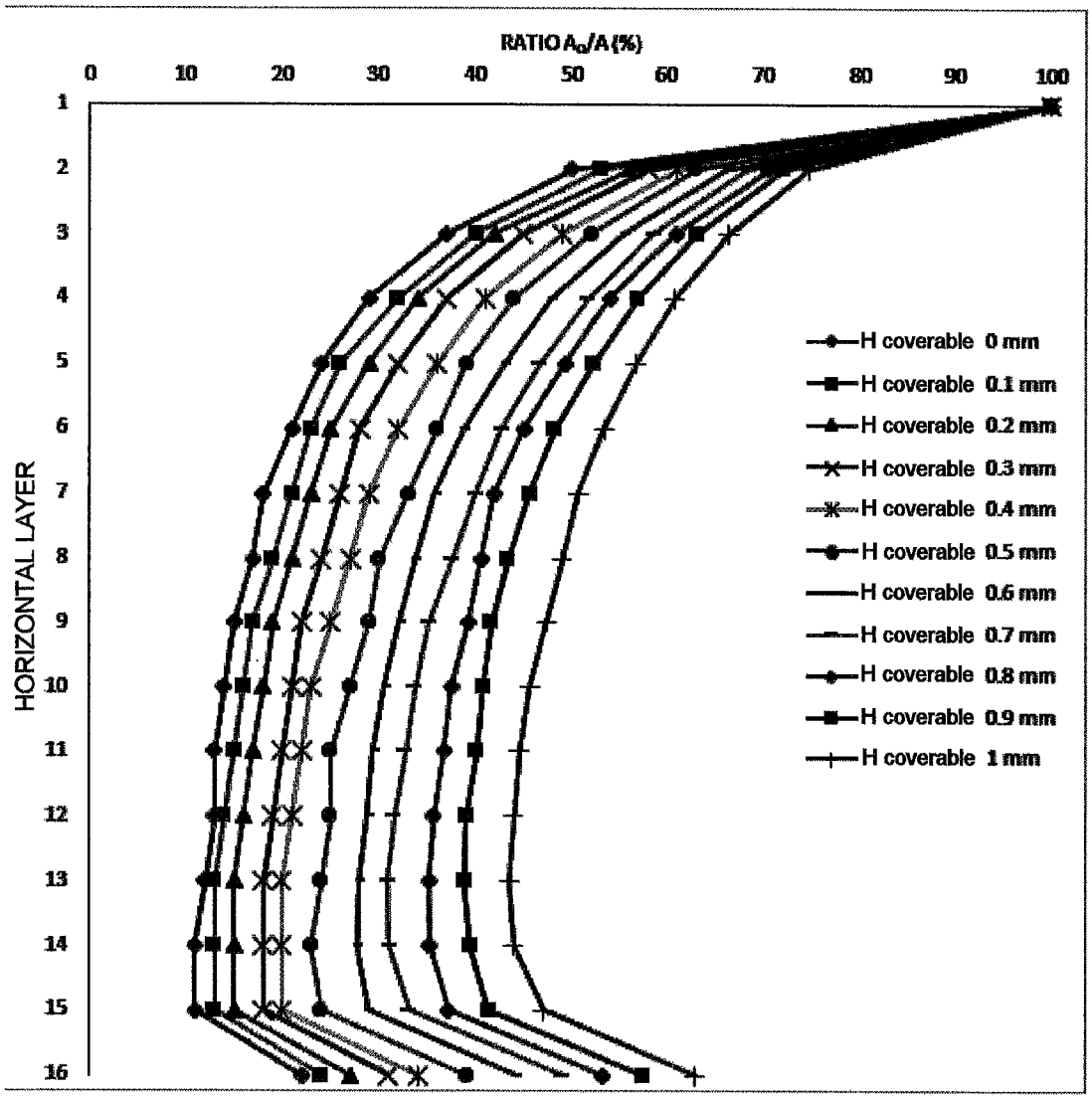
FIG. 9 illustrates the change in the useful section in a wall depending on the compensable height of the levelling layer.

FIG. 9 shows the change in the useful section of a dry-laid masonry wall with a height and width of 3.00 m. The coefficient of useful section of the wall is given in line with each horizontal layer starting from the top of the wall to its base. By comparing a dry-laid wall made of masonry without a levelling layer (Hcoverable=0 mm) and one and the same dray-laid wall with a levelling layer capable of covering a difference of up to 1 mm (0.04"), it can be seen that the critical useful section of the wall is able to pass from 10% to 44% by virtue of the regulating contribution of the contact layer.

The levelling layer(s) may be produced by successive injection of different materials into a manufacturing mould, thereby ensuring very good cohesion and limited manufacturing costs.

The invention claimed is:

1. A construction system for dry assembly of a wall, comprising:

a parallelepiped-shaped construction block composed of concrete, the block having:

two opposite main faces;

an upper face;

a lower face; and a first lateral face opposite a second lateral face;

the upper and lower faces and the lateral faces each having, respectively, complementary reliefs that are able to interlock when several of the blocks are juxtaposed to form the wall; and one or more discrete levelling layers coextensively positioned on at least one of the upper face and the lower face, the one or more levelling layers have a thickness being at least one of greater than 5 mm (0.196 inch) and less than 40 mm (1.575 inch) and are composed of an injection-molded mortar having a Young's modulus less than 4000 MPa (0.58 $10^6$ pounds per square inch) and a compressive strength less than 6 MPa (870 pounds per square inch), wherein the one or more levelling layers extend along an entire length of the block and are located thereon prior to said dry assembly of the wall.

2. The system according to claim 1, wherein the mortar has at least one of a Young's modulus greater than 1000 MPa (0.145 $10^6$ pounds per square inch) and a compressive strength greater than 1 MPa (145 pounds per square inch).

3. The system according to claim 1, wherein the mortar comprises:

a binder based on cement, and granules, an average diameter of which is limited to half the thickness of the corresponding levelling layer.

4. The system according to claim 1, wherein the mortar comprises:

a binder based on cement, and granules, an average diameter of which is less than 1.5 mm (0.059 inch).

5. The system according to claim 1, wherein the concrete forming a central part of the block has at least one of a Young's modulus greater than 20 000 MPa (2.9 $10^6$ pounds per square inch) and a compressive strength greater than 20 MPa (2901 pounds per square inch).

6. The system according to claim 1, wherein the relief of the upper face comprises two tenons extending in parallel and at a distance from the two main faces, respectively, and the relief of the lower face comprises two corresponding slots extending in parallel and at a distance from the two main faces, respectively; and wherein the levelling layers on the upper face are situated on at least one of the tenons and laterally, towards outside, with respect to said tenons.

7. The system according to claim 1, wherein the relief of the upper face comprises two tenons extending in parallel and at a distance from the two main faces, respectively, and the relief of the lower face comprises two corresponding slots extending in parallel and at a distance from the two main faces, respectively; and wherein the levelling layers on the lower face are situated on at least one of a bottom of the slots and laterally, towards outside, with respect to said slots.

8. The system according to claim 1, wherein said construction block comprises:

voids and a continuity of solid material, along the entire length of the block, between each of the tenons of the upper face and a corresponding slot of the lower face, and the voids comprise:

the voids extending vertically between the tenons of the upper face and the corresponding slots of the lower face.

9. The system according to claim 8, wherein the voids comprise:

the voids extending vertically between, for a first part, each of the main faces and, for a second part, the tenon adjacent to the upper face and the corresponding slot of the lower face.

10. The system according to claim 1, wherein the first lateral face comprises a central tenon and two lateral tenons on either side of the central tenon, and the second lateral face comprises a corresponding central slot and two corresponding lateral slots on either side of the corresponding central slot.

11. The system according to claim 10, wherein the central tenon of the first lateral face and the corresponding central slot of the second lateral face have a trapezoidal section.

12. The system according to claim 10, wherein the central tenon of the first lateral face and the corresponding central slot of the second lateral face are situated transversely between two tenons of the upper face and between two slots of the lower face.

13. The system according to claim 10, wherein the central tenon of the first lateral face and the corresponding central slot of the second lateral face have a maximum width ($e_1$, $e_{1'}$) of between 25% and 30% of a width (L) of the block.

14. The system according to claim 10, wherein each of the two lateral tenons of the first lateral face is aligned with the adjacent main face, and each of the two lateral slots of the second lateral face is aligned with the adjacent main face.

15. The system according to claim 10, wherein each of the at least two lateral tenons of the first lateral face has a height (h) of between 8% and 15% of a width of the block.

16. The system according to claim 1, wherein the relief of the upper face comprises two tenons extending in parallel and at a distance from the two main faces, respectively, and the relief of the lower face comprises two corresponding slots extending in parallel and at a distance from the two main faces, respectively.

17. The system according to claim 16, wherein each of the tenons of the upper face has a thickness (E) of between 10% and 17% of the width (L) of the block.

18. The system according to claim 16 wherein each of the tenons of the upper face is at a distance (D) from the adjacent main face of between 20% and 25% of a width (L) of the block.

19. The system according to claim 16, wherein each of the upper face and lower face has a substantially straight transverse profile on either side of the two tenons of said upper face and the two slots of said lower face, respectively, the central part of the upper face is vertically set back (R) with respect to the substantially straight transverse profile on either side of the two tenons, said setback (R) being greater than or equal to 1 mm (0.04 inch).

20. The system according to claim 16, wherein each of the tenons of the upper face has a height (H) greater than a thickness (E) of said tenon, and each of the slots of the lower face has a depth (H') greater than a width (E') of said slot.

21. The system according to claim 16, wherein the reliefs of the upper face and lower face are configured such that central parts of said faces, which are situated between the two tenons and the two corresponding slots, respectively, are at a distance from the facing central part of another block that is identical to said block and engaged with said block.

22. The system according to claim 21, wherein the central part of the upper face has no tenon and the central part of the lower face has no slot.

* * * * *